US008485794B2

(12) United States Patent
Lee et al.

(10) Patent No.: US 8,485,794 B2
(45) Date of Patent: Jul. 16, 2013

(54) RECIPROCATING COMPRESSOR WITH ROTARY VALVE

(75) Inventors: Geon Ho Lee, Seongnam-si (KR); Dong Hui Lee, Anseong-si (KR); Seok Bong Lee, Sacheon-si (KR); Ki Beom Kim, Anseong-si (KR); Joung Hyun Park, Seoul (KR)

(73) Assignees: Doowon Technical College, Anseing-Shi (KR); Doowon Electronic Co., Ltd., Asan-Shi (KR)

( * ) Notice: Subject to any disclaimer, the term of this patent is extended or adjusted under 35 U.S.C. 154(b) by 303 days.

(21) Appl. No.: 12/997,752

(22) PCT Filed: Jun. 9, 2009

(86) PCT No.: PCT/KR2009/003087

§ 371 (c)(1),
(2), (4) Date: Jan. 18, 2011

(87) PCT Pub. No.: WO2009/151259

PCT Pub. Date: Dec. 17, 2009

(65) Prior Publication Data

US 2011/0107906 A1 May 12, 2011

(30) Foreign Application Priority Data

Jun. 13, 2008 (KR) ..... 10-2008-0055577
Nov. 20, 2008 (KR) ..... 10-2008-0115745
Mar. 31, 2009 (KR) ..... 10-2009-0027318

(51) Int. Cl.
*F01B 3/00* (2006.01)

(52) U.S. Cl.
USPC ..... 417/269; 92/71

(58) Field of Classification Search
USPC ..... 417/269; 91/503; 92/71
See application file for complete search history.

(56) References Cited

U.S. PATENT DOCUMENTS 5,232,349 A * 8/1993 Kimura et al. ..... 417/222.1
5,380,165 A * 1/1995 Kimura et al. ..... 417/269

(Continued)

FOREIGN PATENT DOCUMENTS

JP 03-275721 5/1993
JP 04-262371 4/1994

(Continued)

OTHER PUBLICATIONS

International Preliminary Report on Patentability issued Jan. 18, 2011 by the International Bureau on behalf of the International Searching Authority for application PCT/KR2009/003087 filed Sep. 6, 2009, which later published as WO2009/151259 on Dec. 17, 2009 (Applicant—Doowon Technical College // Inventor—Lee et al.) (6 pages).

(Continued)

*Primary Examiner* — Charles Freay
(74) *Attorney, Agent, or Firm* — Ballard Spahr, LLP

(57) ABSTRACT

According to the present invention, a reciprocating compressor with a rotary valve comprises a cylinder block with plural cylinder bore, a drive shaft which is supported and permitted to rotate in relation to the cylinder block, a piston which is housed in the cylinder bore and allowed to reciprocate therein, a power transmitting unit which connects the piston and drive shaft, a rear housing wherein an intake chamber and exhaust chamber are formed, and a rotary valve which rotates with the drive shaft and is installed in the inner surface of a coupling hole formed in the cylinder block and permitted to slide and rotate therein. In the inner circumference of the cylinder block, connection holes are respectively connected to the cylinder bore. A bypass unit is included between the coupling hole and rotary valve and bypasses the refrigerant remaining in the connection hole of one cylinder bore during the compressive stroke of the piston, then discharges it through the connection hole of another cylinder bore.

22 Claims, 9 Drawing Sheets

U.S. PATENT DOCUMENTS

| | | | | |
|---|---|---|---|---|
| 5,385,450 | A * | 1/1995 | Kimura et al. | 417/269 |
| 5,486,098 | A * | 1/1996 | Kimura et al. | 417/222.2 |

FOREIGN PATENT DOCUMENTS

| | | |
|---|---|---|
| JP | 05-332527 | 9/1994 |
| JP | 2006-203653 | 2/2008 |
| KR | 10-2006-0074133 | 10/2009 |
| KR | 10-2008-0055577 | 2/2010 |
| KR | 10-2008-0115745 | 10/2010 |
| KR | 10-2009-0027318 | 12/2011 |
| WO | PCT/KR2009/003087 | 12/2009 |

OTHER PUBLICATIONS

International Search Report issued Sep. 16, 2009 by the International Searching Authority for application PCT/KR2009/003087 filed Sep. 6, 2009, which later published as WO 2009/151259 on Dec. 17, 2009 (Applicant—Doowon Technical College // Inventor—Lee et al.) (2 pages).

Written Opinion issued Sep. 16, 2009 by the International Searching Authority for application PCT/KR2009/003087 filed Sep. 6, 2009, which later published as WO 2009/151259 on Dec. 17, 2009 (Applicant—Doowon Technical College // Inventor—Lee et al.) (5 pages).

* cited by examiner (PRIOR ART)

(PRIOR ART)

(PRIOR ART)

(PRIOR ART)

RECIPROCATING COMPRESSOR WITH ROTARY VALVE

CROSS REFERENCE TO RELATED APPLICATIONS

The present application is a National Phase Application of International Application No. PCT/KR2009/003087, filed Jun. 9, 2009, which claims priority to Korean Patent Applications No. 10-2008-0055577, filed Jun. 13, 2008, No. 10-2008-0115745, filed Nov. 20, 2008; and No. 10-2009-0027318, filed Mar. 31, 2009, which applications are incorporated herein fully by this reference.

TECHNICAL FIELD

The present invention relates to a reciprocating compressor with a rotary value, and more particularly to a reciprocating compressor with a rotary value which is excellent in its durability, whose volume efficiency and performance are remarkably improved, and which does not generate pulsation noise.

BACKGROUND ART

In general, an air conditioning system for a vehicle is adapted to set the interior temperature of the vehicle to be lower than the exterior temperature using a refrigerant, and includes a compressor, a condenser, and an evaporator to form a refrigerant circulation cycle.

A type of compressor, i.e. a reciprocating compressor includes a cylinder and a piston reciprocating within the cylinder and is commonly used in an air conditioning system for home, industry, or vehicles. A representative example of such a reciprocating compressor is a swash plate compressor.

In a swash plate compressor, a disk-shaped swash plate is installed on a drive shaft receiving power of an engine with the inclination thereof being varied or fixed in correspondence to rotation of the drive shaft and a plurality of pistons installed by interposing a shoe along the periphery of the swash plate linearly reciprocate within a plurality of bores formed in a cylinder block while the swash plate is rotating, whereby a refrigerant gas is suctioned or compressed to be discharged.

A valve plate configured to control the suction and discharge of a refrigerant gas in the process of suctioning or compressing and discharging the refrigerant gas is installed between the housing and the cylinder block.

Hereinafter, a general swash plate compressor will be described with reference to FIG. 1.

The swash type compressor of FIG. 1 includes a front housing A10 in which a front cylinder block A20 is embedded, a rear housing A10*a* coupled to the front housing A10 and in which a rear cylinder block A20*a* is embedded, a plurality of pistons A50 configured to reciprocate in a plurality of cylinder bores A21 formed in the front and rear cylinder blocks A20 and A20*a*, a swash plate A40 inclinedly coupled to a drive shaft A30 and coupled to the pistons A50 with a shoe A45 being installed along the outer periphery thereof, valve plates A60 installed between the front and rear housings A10 and A10*a* and the front and rear cylinder blocks A20 and A20*a*, and a muffler installed at an upper portion of the outer surface of the rear housing A10*a* and configured to supply a refrigerant fed from an evaporator into the compressor during a suction stroke of the piston A50 and to discharge the refrigerant compressed in the compressor A1 toward a condenser.

A refrigerant discharge chamber A12 and a refrigerant suction chamber A11 are formed respectively inside and outside a partition wall A13 in the front and rear housings A10 and A10*a*. Here, the refrigerant discharge chamber 12 is divided into a first discharge chamber A12*a* formed inside the partition wall A13 and a second discharge chamber A12*b* formed outside the partition wall A13 and communicated with the first discharge chamber A12*a* through a discharge hole. Accordingly, the refrigerant in the first discharge chamber A12*a* flows into the second discharge chamber A12*b* via the discharge hole A12*c* of small diameter, making it possible to damp a pulsation pressure due to a suction operation of the refrigerant and reduce vibration and noise.

Meanwhile, a plurality of suction passages A22 are formed in the front and rear cylinder blocks A20 and A20*a* so that the refrigerant supplied into the swash plate chamber A24 provided between the front and rear cylinder blocks A20 and A20*a*, and the second discharge chambers A12*b* of the front and rear cylinder blocks A10 and A10*a* are communicated with each other by a connecting passage passing through the front and rear cylinder blocks A20 and A20*a*. Thus, as the pistons reciprocate, the refrigerant is suctioned and compressed simultaneously within the bores A21 of the front and rear cylinder blocks A20 and A20*a*.

The conventional swash plate compressor compresses a refrigerant through the following process.

The refrigerant supplied from an evaporator is suctioned into a suction portion of the muffler A70 and then is supplied into the swash plate chamber A24 between the front and rear cylinder blocks A20 and A20*a*, and the refrigerant supplied into the swash plate chamber A24 flows into the refrigerant suction chambers A11 of the front and rear housings A10 and A10*a* along the suction passages A22 formed in the front and rear cylinder blocks A20 and A20*a*.

Then, the suction lead valve is opened during the suction stroke of the piston A50, and the refrigerant in the refrigerant suction chamber A11 is suctioned into the cylinder bores A21 through a refrigerant suction hole of the valve plate A60. During the compression stroke of the piston, the refrigerant in the cylinder bore A21 is compressed, and the refrigerant flows into the first discharge chambers A12*a* in the front and rear housings A10 and A10*a* through the refrigerant discharge holes of the valve plates A60 as the discharge lead value is opened. After the refrigerant in the first discharge chamber A12*a* is discharged to the discharge portion of the muffler A70 through the refrigerant discharge opening A72 of the muffler A70 via the second discharge chamber A12*b*, it flows into the condenser.

Meanwhile, after the refrigerant compressed in the cylinder bore A21 of the front cylinder block A20 is discharged to the first discharge chamber A12*a* of the front housing A10 and then flows into the second discharge chamber A12*b*, it flows into the second discharge chamber A12*b* of the rear housing A10*a* along the connecting passages A23 formed in the front and rear cylinder blocks A20 and A20*a* to be discharged to the discharge portion of the muffler A70 through the refrigerant discharge opening together with the refrigerant in there.

However, in the conventional compressor A1, the suction volume efficiency of a refrigerant is reduced by a loss due to suction resistance caused by the complex refrigerant passages, a loss due to the elasticity resistance of the suction lead valve during an opening/closing operation of the valve plate A60, etc.

Further, pulsation noise is generated when a suction lead and a discharge lead are opening or closed.

Furthermore, the suction lead and the discharge lead are damaged after long term use thereof, making it impossible to perform their own functions.

Meanwhile, a technology for reducing a loss due to an elasticity resistance of such a suction lead valve is disclosed in Korean Laid-Open Patent No. 2007-19564 ("a compressor", hereinafter referred to as "Prior Art").

The prior art relates to a compressor to which a drive shaft integrated suction rotary valve having no suction lead valve is applied and allows a refrigerant to enter cylinder bores through the interior of a drive shaft to reduce a loss due to a suction resistance.

In more detail, as illustrated in FIG. 2, the compressor according to the prior art includes: a drive shaft B150 on which a swash plate B160 is inclinedly coupled, having a fluid passage B151 through which a refrigerant flows, having at least one suction opening B152 communicated with the fluid passage B151 on the side of a swash plate hub to which the swash plate B160 is coupled, and having an exit B153 at a position spaced apart from the suction opening B152; front and rear cylinder blocks B130 and B140 in which the drive shaft B150 is rotatably installed, having a plurality of cylinder bores B131 and B141 on opposite sides of a swash plate chamber B136, and having suction passages B132 and B142 communicating shaft support holes B133 and B143 with the cylinder bores B131 and B141 so that a refrigerant suctioned into the fluid passage B151 of the drive shaft B150 can be sequentially suctioned into the cylinder bores B131 and B141 while the drive shaft B150 is rotating; a plurality of pistons B170 mounted to the swash plate B160 by interposing a shoe at the periphery of the swash plate B160 and configured to reciprocate within the cylinder bores B131 and B141 in conjunction with rotation of the swash plate B160; and front and rear housings B110 and B120 coupled to opposite sides of the cylinder blocks B130 and B140 and having discharge chambers therein respectively.

In the compressor of the prior art, after the refrigerant introduced through a suction port (not shown) is introduced into the interior of the drive shaft B150 through the suction opening B152 formed on the hub side of the swash plate B160, it is introduced into the cylinder bores B131 and B141 via the fluid passage B151 formed in the interior of the drive shaft B150.

According to the prior art, when a piston reaches a top dead point where compression is completed, almost all of the compressed refrigerant of high pressure is discharged to the refrigerant discharge chambers of the front and rear housings and some of the refrigerant is kept within the suction passage. Then, the refrigerant left in the suction passage in a state of high pressure impedes suction of a refrigerant (in a low pressure state) introduced into the suction passage to perform a suction stroke, making it difficult to perform a suction operation. Further, a sufficient amount of fluid cannot be securely suctioned due to a refrigerant flow resistance in the suction passage.

DISCLOSURE

Technical Problem

Therefore, it is an object of the present invention to provide a reciprocating compressor with a rotary value which is excellent in its durability, whose volume efficiency and performance are remarkably improved, and which does not generate pulsation noise.

It is another object of the present invention to provide a reciprocating compressor with a rotary value which allows a refrigerant passing therethrough to be more smoothly suctioned by removing the refrigerant left within a communication hole.

It is still another object of the present invention to provide a reciprocating compressor with a rotary value which enhances the volume efficiency thereof by supplying the refrigerant left within the communication hole to another cylinder bore and increasing the amount of suctioned refrigerant.

Technical Solution

In order to achieve the above-mentioned objects, there is provided a reciprocating compressor with a rotary valve comprising: a cylinder block having a plurality of bores; a drive shaft rotatably supported by the cylinder block; a plurality of pistons reciprocally accommodated within the cylinder bores; a power transmission connecting the pistons and the drive shaft; a housing having a suction chamber and a discharge chamber; and a rotary valve configured to rotate together with the drive shaft and slidably installed on an inner surface of a coupling hole formed in the cylinder block, wherein communication holes connected to the plurality of cylinder bores respectively are formed on an inner peripheral surface of the coupling hole of the cylinder block, and wherein a bypass means for bypassing a refrigerant left within the communication hole of the cylinder bore in which a compression stroke is performed and then discharging the refrigerant to the communication hole of another cylinder bore is provided between the coupling hole and the rotary valve.

Preferably, in the bypass means, at least one temporary storage groove is formed in an inner peripheral surface of the coupling hole of the cylinder block along a circumferential direction thereof and a first discharge groove and a second discharge groove communicated with the temporary storage groove with the refrigerant discharge opening being interposed therebetween are formed on an outer peripheral surface of the rotary valve.

Preferably, two temporary grooves are formed on opposite sides of the communication holes.

Preferably, the first discharge groove and the second discharge groove extend in the direction of the drive shaft.

Preferably, the bypass means includes first and second discharge grooves formed in the rotary valve and extending in the direction of the drive shaft to be communicated with the communication holes with the refrigerant discharge opening being interposed therebetween, and a bypass passage formed by spacing an end of the rotary valve and a bottom of the coupling hole apart from each other to face each other such that the first and second discharge grooves are communicated with each other.

Preferably, the rotary valve is detachably coupled to the drive shaft.

The present invention also provides a reciprocating compressor with a rotary valve comprising: a cylinder block having a plurality of bores; a drive shaft rotatably supported by the cylinder block; a plurality of pistons reciprocally accommodated within the cylinder bores; a power transmission connecting the pistons and the drive shaft; a housing having a suction chamber and a discharge chamber; and a rotary valve configured to rotate together with the drive shaft and slidably installed on an inner surface of a coupling hole formed in the cylinder block, wherein communication holes connected to the plurality of cylinder bores respectively are formed on an inner peripheral surface of the coupling hole of the cylinder block, wherein a bypass means for bypassing a refrigerant left within the communication hole of the cylinder bore in which a compression stroke is performed and then discharging the refrigerant to the communication hole of another cylinder bore is provided between the coupling hole and the rotary valve, and wherein the rotary valve is resiliently pushed toward the inner side of the coupling hole.

Preferably, the rotary valve includes a suction rotor installed at a rear end of the drive shaft and having an accommodating recess opened rearward and a refrigerant discharge opening formed on a side surface thereof to communicate the accommodating recess and the communication holes, a blocking wall formed between the suction chamber and the suction rotor and having a suction port communicated with the suction chamber, and a spring disposed between the suction rotor and the blocking wall to prevent a shaft from being pushed, and the refrigerant discharge opening and the communication holes are intermittently communicated with each other as the drive shaft and the suction rotor rotate.

Preferably, the bypass means includes first and second discharge grooves formed in the rotary valve and extending in the direction of the drive shaft to be communicated with the communication holes with the refrigerant discharge opening being interposed therebetween in the direction of circumferential direction of the rotary valve, and a bypass passage formed by spacing the facing surface of the suction rotor and the coupling hole apart from each other such that the first and second discharge grooves are communicated with each other.

Preferably, a thrust bearing to which a force is applied by the spring is provided on the inner side of the accommodating recess.

Preferably, the spring is disposed between a bottom of the accommodating recess of the suction rotor and the blocking wall.

Preferably, a radial bearing is interposed between the drive shaft and the cylinder block.

Preferably, a recess or a boss is formed at a rear end of the drive shaft, and a boss or a recess coupled to the recess or boss of the drive shaft is formed at a tip end of the suction rotor.

Preferably, a coupling structure of the rear end of the drive shaft and the tip end of the suction rotor is a fitting structure.

Preferably, in the bypass means, at least one temporary storage groove is formed on an inner peripheral surface of the coupling hole of the cylinder block along a circumferential direction thereof and a first discharge groove and a second discharge groove communicated with the temporary storage groove with the refrigerant discharge opening being interposed therebetween are formed on an outer peripheral surface of the rotary valve.

Preferably, two temporary grooves are formed on opposite sides of the communication holes.

Preferably, the first discharge groove and the second discharge groove extend in the direction of the drive shaft.

Preferably, when seen from the direction of the drive shaft, the first and second discharge grooves are stepped to have a flat surface.

Preferably, when seen from the direction of the drive shaft, the first and second discharge grooves are recessed.

The present invention also provides a reciprocating compressor with a rotary valve including a cylinder block having a plurality of bores, a drive shaft rotatably supported by the cylinder block, a plurality of pistons reciprocally accommodated within the cylinder bores, a power transmission connecting the pistons and the drive shaft, a housing having a suction chamber and a discharge chamber, and a rotary valve configured to rotate together with the drive shaft and slidably installed on an inner surface of a coupling hole formed in the cylinder block, the reciprocating compressor comprising: a suction rotor installed at a rear end of the drive shaft and having an accommodating recess opened rearward and a refrigerant discharge opening formed on a side surface thereof to communicate the accommodating recess and the communication holes; a blocking wall formed between the suction chamber and the suction rotor and having a suction port communicated with the suction chamber; and a spring disposed between the suction rotor and the blocking wall to prevent a shaft from being pushed; wherein communication holes connecting the cylinder bores and an outer surface of the suction rotor are formed in the cylinder blocks and the refrigerant discharge opening and the communication holes are intermittently communicated with each other as the drive shaft and the suction rotor rotate.

MODE FOR INVENTION

Hereinafter, exemplary embodiments of the present invention will be described in detail with reference to the accompanying drawings.

Figure 1A:
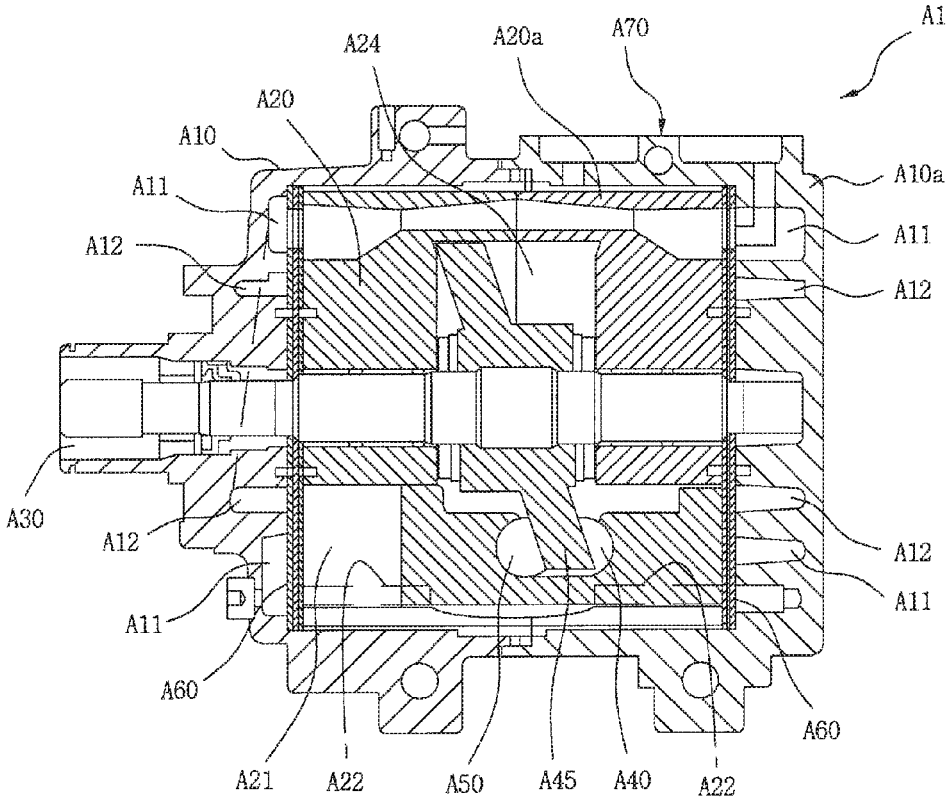
FIG. 1 illustrates a front sectional view and a side sectional view illustrating a general swash plate compressor.
Figure 1B:
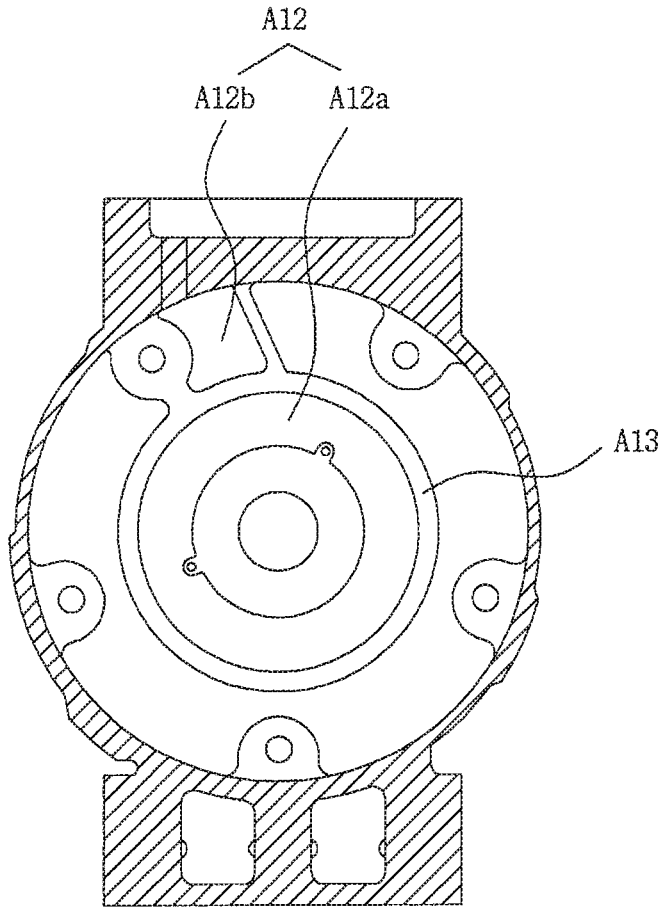
Figure 2:
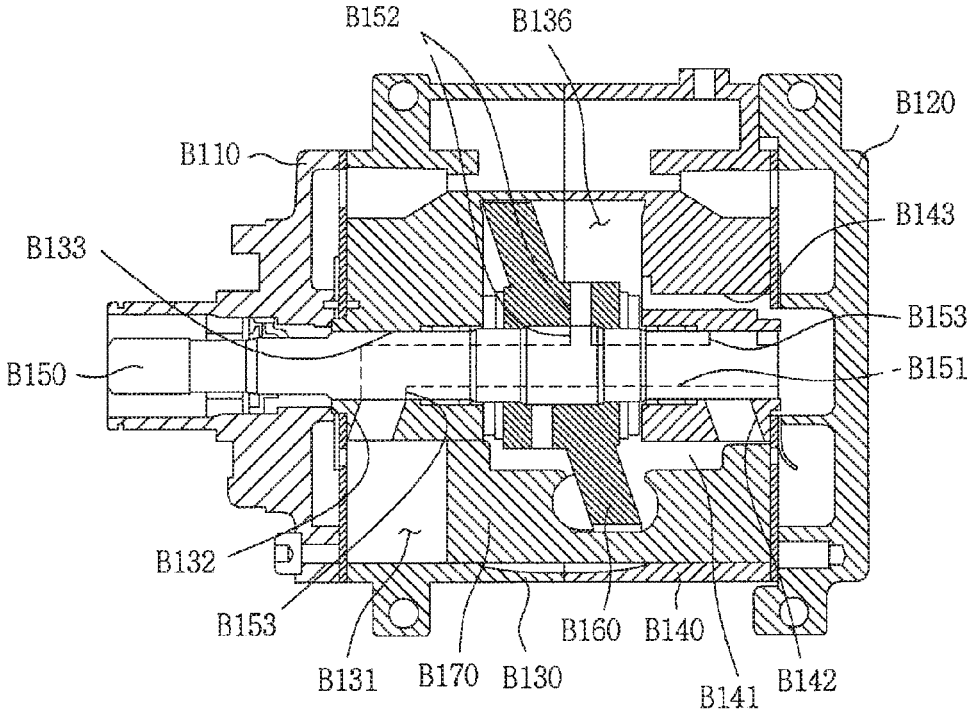
FIG. 2 is a sectional view illustrating a swash plate compressor to which a rotary valve is mounted according to the prior art.
Figure 3:
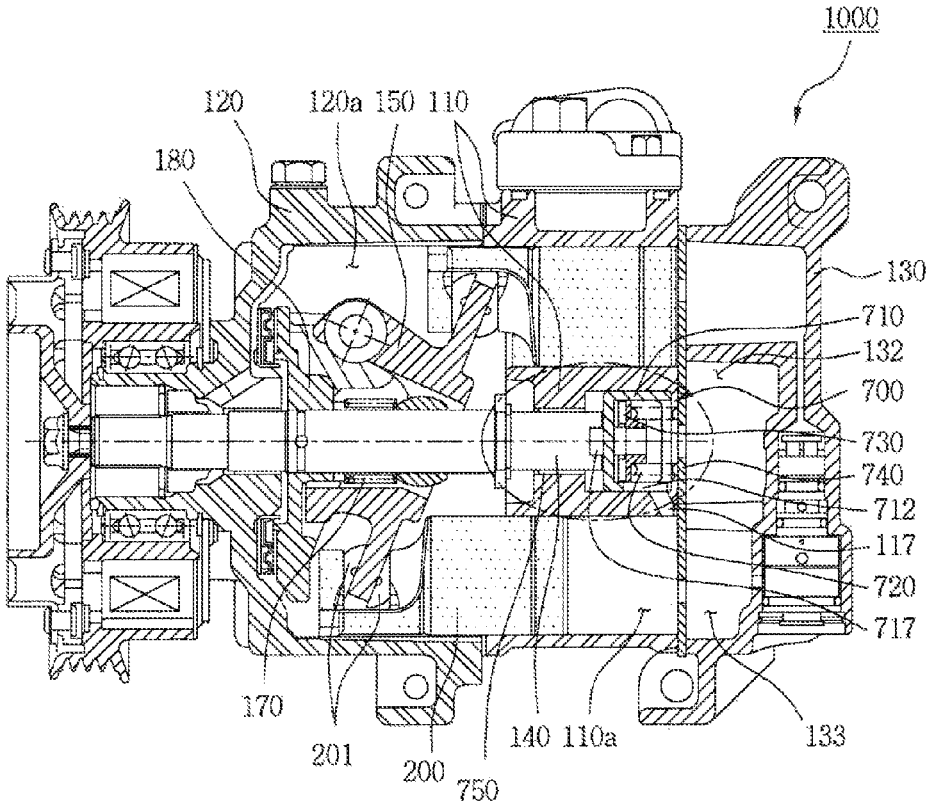
FIG. 3 is a sectional view illustrating a reciprocating compressor with a rotary valve according to the present invention.

FIG. 3 is a sectional view illustrating a swash plate compressor according to the present invention.

It is apparent that although this embodiment of the present invention illustrates a variable capacity swash plate compressor, the present invention can be applied to other general reciprocating compressors.

As illustrated in FIG. 3, the swash plate compressor 1000 according to the present invention includes: a cylinder block 110 having a plurality of cylinder bores 110*a* formed on the inner peripheral surface thereof in parallel along the lengthwise direction thereof and forming the outer shapes of the compressor; a front housing 120 disposed at a front end of the cylinder block 110 to define a swash plate chamber 120*a*; a drive shaft rotatably supported by the cylinder block 110 and the front housing 120; a lug plate 180 fixed to the drive shaft 140 within the swash plate chamber 120*a* of the front housing 120; a rear housing 130 having a suction chamber 132 and a discharge chamber 133 therein and disposed at a rear end of the cylinder block 110; a swash plate 150 whose inclination can be varied while it is being rotated by the lug plate 180 and having a circular plate shape; a spring 170 supported between the lug plate 180 and the swash plate 150; and a plurality of pistons 200 accommodated within the cylinder bores 110*a* respectively and configured to reciprocate with the cylinder bores 110*a*.

A coupling hole 111 is formed in the cylinder block 110 and a rotary valve 700 is slidably installed in the coupling hole 111 of the cylinder block 110.

A plurality of communication holes 117 connecting the cylinder bores 110*a* and the rotary valve 700 are formed in the cylinder block 110.

Meanwhile, the compressor includes bypass means 800 formed between the coupling hole 111 and the rotary valve 700 and configured to bypass a refrigerant left in the communication hole 117 of a cylinder bore 110*a* during a compression stroke of a piston 200 to discharge the left refrigerant to the communication hole 117 of another cylinder bore 110*a*.

Hereinafter, the rotary valve 700 and the bypass means 800 for discharging a refrigerant of high pressure left in the communication holes 117 will be described in detail.

Embodiment 1

Figure 4:
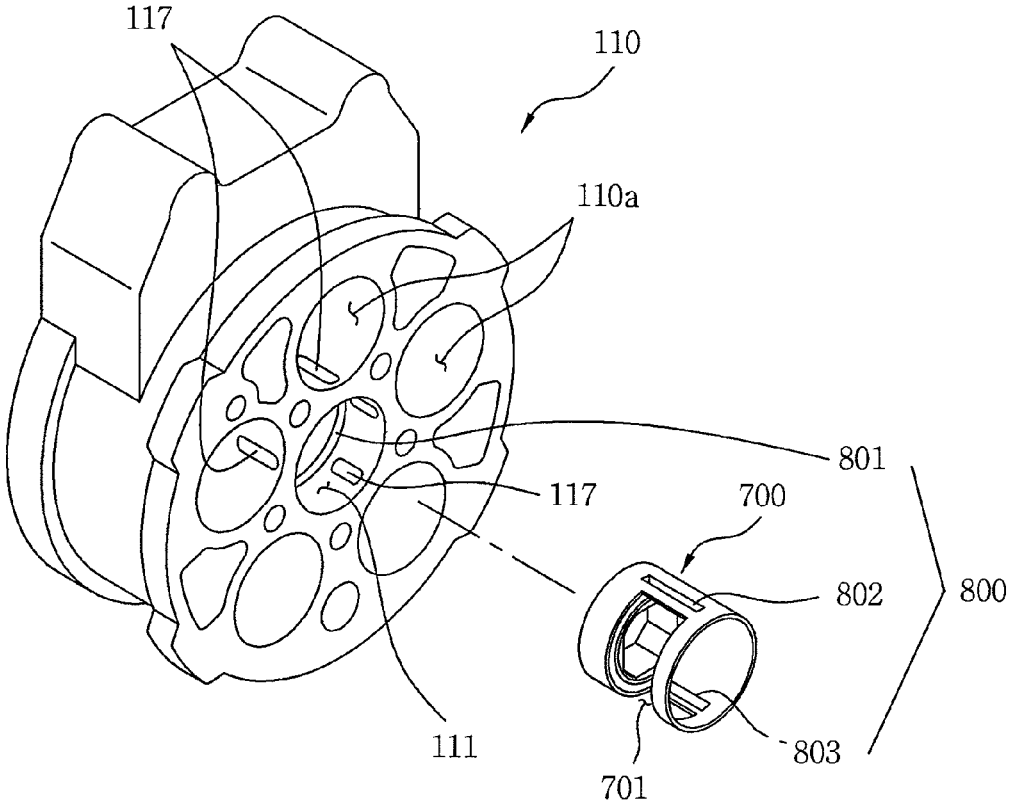
FIG. 4 is an exploded perspective view illustrating a cylinder block and a rotary valve according to the first embodiment of the present invention.
Figure 5:
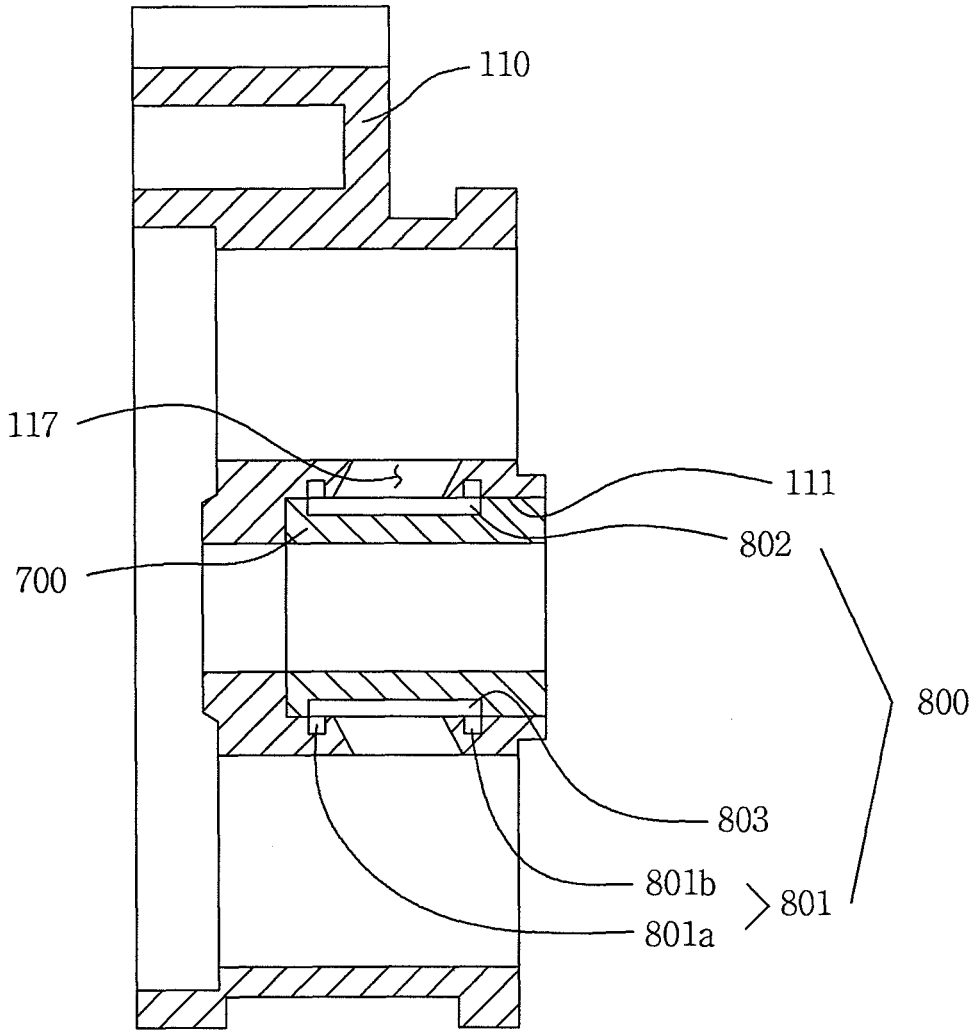
FIG. 5 is a sectional view illustrating the cylinder block and the rotary valve of FIG. 4.

FIG. 4 is an exploded perspective view of a cylinder block and a rotary valve according to the first embodiment of the present invention, and FIG. 5 FIG. 5 is a sectional view illustrating the cylinder block and the rotary valve of FIG. 4.

As illustrated in FIGS. 4 and 5, in the bypass means 800 according to the first embodiment of the prevent invention, a temporary storage groove 801 is formed in an inner peripheral surface of the coupling hole 111 of the cylinder block 110 along a circumferential direction thereof and a first discharge groove 802 and a second discharge groove 803 communicated with the temporary storage groove 801 are formed on the outer peripheral surface of the rotary valve 700.

Meanwhile, it is preferable that a refrigerant discharge opening 701 formed on the outer peripheral surface of the rotary valve 700 to be communicated with the communication holes 117 are formed between the first and second discharge grooves 802 and 803.

When the compression stroke of the piston 200 located within the cylinder bore 110*a* reaches its top dead point, the temporary storage groove 801, the discharge groove 802, and the second discharge groove 803 function to discharge a refrigerant of high pressure left in the communication hole 117 of a cylinder bore 110*a* to a suctioning opposite cylinder bore 110*a*.

The temporary storage groove 801 is formed along the inner peripheral surface of the coupling hole 111 in the shape of a circular ring which is recessed in a certain depth.

As illustrated in FIG. 5, the temporary storage groove 801 may be a first temporary storage groove 801*a* and a second temporary storage groove 801*b* formed along the direction of the drive shaft 140 with a communication hole 117 being interposed therebetween, but may be a single one.

When two or more temporary storage grooves 801 are formed in the direction of the drive shaft 140, the refrigerant left in the communication hole 117 can be fed more promptly, whereby the high speed rotation of the drive shaft 140 can be easily coped with.

One end or opposite ends of the first discharge groove 802 and the second discharge groove 803 are communicated with each other with them facing the temporary storage groove 801 formed on the inner peripheral surface of the coupling hole 111 of the cylinder block.

That is, the first discharge groove 802 and the second discharge groove 803 are formed on opposite sides with the refrigerant discharge opening 701 in the circumferential direction of the rotary valve 700 being interposed therebetween such that the residual gas of high pressure left in the communication hole 117 of one cylinder bore 110*a* is fed to the temporary storage groove 801 though one discharge groove and is discharged from the temporary storage groove 801 to an opposite cylinder bore 110*a* through another discharge groove.

In more detail, the refrigerant in the communication hole 117 is suctioned and sent out to the temporary storage groove 801 through the first discharge groove 802, and the refrigerant stored in the temporary storage groove 801 is discharged to a cylinder bore 110*a* expanded through an opposite communication hole 117 through the second discharge groove 803.

Thus, after the refrigerant left in the communication hole 117 sequentially passes through the first discharge groove 802, the temporary storage groove 801, and the second discharge groove 803 while the drive shaft 140 is rotating, it is discharged to a cylinder bore 110*a* which undergoes a suction stroke through an opposite communication hole 117.

According to the present invention, the residual gas of high pressure in the communication hole 117 can be reused during a compression stroke of the piston 200 by the temporary storage groove 801 formed in the coupling hole 111 of the cylinder block 100, an the first discharge groove 802 and the second discharge groove 803 formed in the rotary valve 700 and compression efficiency can be enhanced by allowing a refrigerant to be smoothly suctioned into a cylinder bore 110*a* at a time point when a suction stroke is performed.

Moreover, the residual gas of high pressure is supplied to a cylinder bore 110*a* which starts to be compressed to increase pressure, making it possible to enhance the compression efficiency of the compressor.

Meanwhile, it is preferable that when seen from the front, the first and second discharge grooves 802 and 803 are stepped to have a flat surface or are recessed.

Embodiment 2

Figure 6:
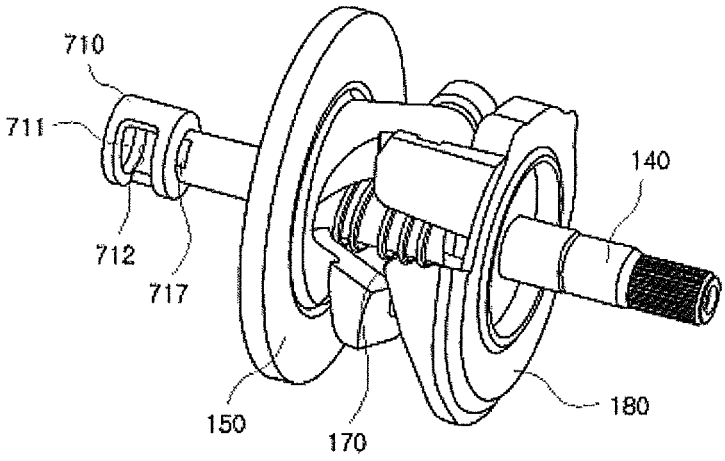
FIG. 6 is a perspective view illustrating a swash plate, a drive shaft, a rotary valve, and their peripheral configurations according to the second embodiment of the present invention.
Figure 7:
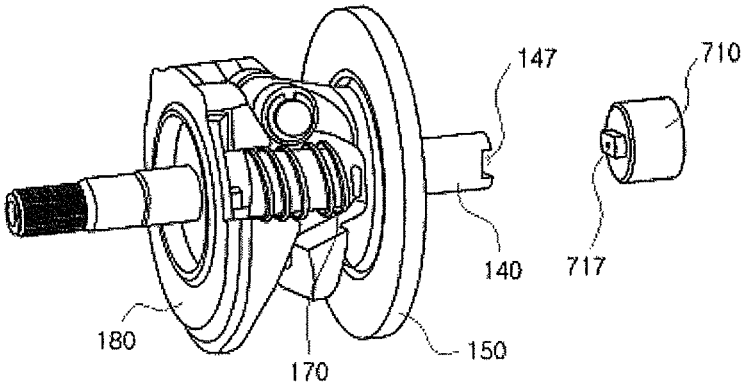
FIG. 7 is a partially exploded perspective view of FIG. 6.
Figure 8:
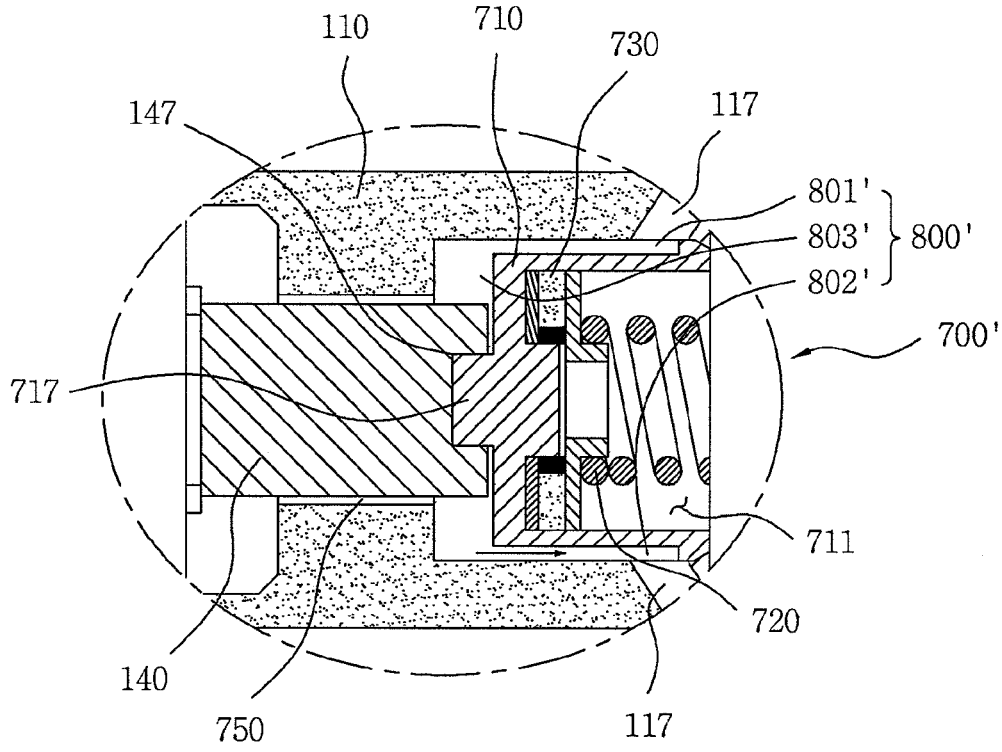
FIG. 8 is a sectional view illustrating a peripheral configuration of the rotary valve of FIG. 6.

FIG. 6 is a perspective view illustrating a swash plate, a drive shaft, a rotary valve, and their peripheral configurations according to the second embodiment of the present invention. FIG. 7 is a partially exploded perspective view of FIG. 6. FIG. 8 is a sectional view illustrating a peripheral configuration of the rotary valve of FIG. 6.

As illustrated in FIGS. 6 to 8, the rotary valve 700' according to the second embodiment of the present invention includes a suction rotor 710 installed at a rear end of the drive shaft 140 to rotate together with the drive shaft 140, and a spring 720 embedded in the suction rotor 710 to apply a force to the front sides of the drive shaft 140 and the suction rotor 710 at the same time.

In more detail, the suction rotor 710 includes an accommodating recess 711 opened rearward, and a refrigerant discharge opening 712 formed on a side surface thereof to be communicated with the accommodating recess 711.

The spring 720 is received in the accommodating recess 711.

In this case, a tip end of the spring 720 resiliently supports the bottom of the accommodating recess 711, and a rear end thereof contacts with a blocking wall 740 to be supported by the blocking wall 740.

By the spring 720, the drive shaft 140 is prevented from being pushed during the operation of the compressor and the suction rotor 710 is pushed to the drive shaft 140 to be firmly supported.

A thrust bearing 730 is interposed between the bottom surface of the accommodating recess 711 and the tip end of the spring 720 to reduce friction during rotation of the suction rotor 710.

Meanwhile, the blocking wall 740 having a suction port 741 communicated with the suction chamber 132 is formed between the suction chamber 132 and the suction rotor 710.

Communication holes 117 connecting the cylinder bores 110*a* and the suction rotor 710 are formed in the cylinder block 110.

Accordingly, as the drive shaft 140 and the suction rotor 710 rotate, the refrigerant discharge opening 712 and the communication holes 117 are intermittently communicated with each other to supply the suctioned coolant into the cylinder bores 110*a*.

For smooth rotation of the drive shaft 140, a radial bearing 750 is interposed between the drive shaft 140 and the cylinder block 110. In the drawing, a metal bush is employed as the radial bearing 750, but a general ball bearing or a general roller bearing may be used.

Meanwhile, as a coupling structure of the drive shaft 140 and the suction rotor 710, a recess 147 or a boss may be formed at a rear end of the drive shaft 140 and a boss 717 or a recess coupled to the recess 147 or boss of the drive shaft may be formed at a tip end of the suction rotor 710.

In this case, the boss-recess coupling structure of the drive shaft 140 and the suction rotor 710 may be a fitting structure to easily adapt mutual movement thereof due to an assembly error while power is being transmitted.

As illustrated in FIG.8, the bypass means 800' according to the second embodiment of the present invention includes a first discharge groove 801' and a second discharge groove 802' formed in the suction rotor 710 and extending in the direction of the drive shaft 140 to be communicated with the communication holes 117 with the refrigerant discharge opening 712 being interposed therebetween in the direction of circumferential direction of the rotary valve, and a bypass passage 803' formed by the surfaces of the suction rotor 710 and the coupling hole 111 spaced apart from each other to face each other such that the first discharge grooves 801' and 802' are communicated with each other.

Meanwhile, it is preferable that one of the first discharge groove 801' and the second discharge groove 802' are communicated with the communication hole 117 of the cylinder bore 110*a* performing a compression stroke, and the other of the first discharge groove 801' and the second discharge groove 802' are communicated with the communication hole 117 of the cylinder bore 110*a* performing a suction stroke.

Thus, while the drive shaft 140 is rotating, after the refrigerant left in the communication hole 117 sequentially passes through the first discharge groove 801', the bypass passage 803', and the second discharge groove 802', it is discharged to the cylinder bore 110*a* performing a suction stroke through the opposite communication hole 117.

Figure 9:
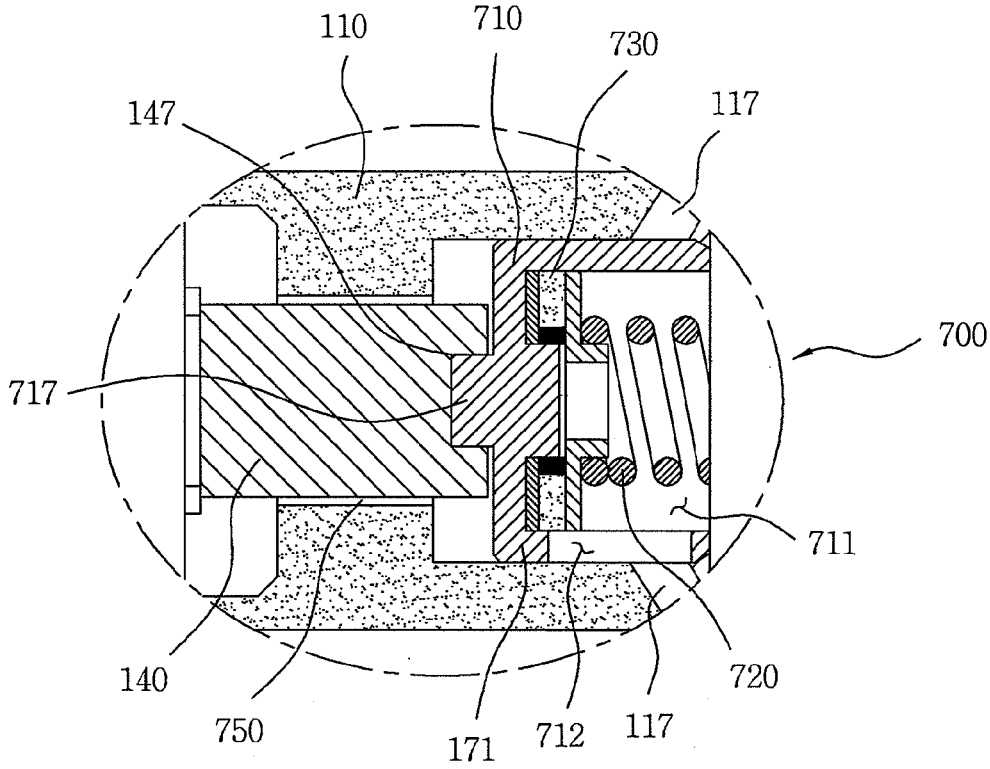
FIG. 9 is a sectional view of a reciprocating compressor with a rotary valve from which the bypass means of FIG. 8 is removed.

Meanwhile, a reciprocating compressor with a rotary valve that enhances durability and reduces pulsation noise without using a bypass structure is illustrated in FIG. 9. The remaining structure of the reciprocating compressor of FIG. 9 is the same as in FIG. 8, and its description will be omitted.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

For example, the bypass means 800' according to the second embodiment of the present invention may be applied to the rotary valve 700 of the first embodiment of the present invention, and the bypass means 800 according to the first embodiment of the present invention may be applied to the rotary valve 700' according to the second embodiment of the present invention.

The invention claimed is:

1. A reciprocating compressor with a rotary valve comprising:

a cylinder block having a plurality of bores;

a drive shaft rotatably supported by the cylinder block;

a plurality of pistons reciprocally accommodated within the cylinder bores;

a power transmission connecting the pistons and the drive shaft;

a housing having a suction chamber and a discharge chamber; and a rotary valve configured to rotate together with the drive shaft and slidably installed on an inner surface of a coupling hole formed in the cylinder block, wherein communication holes connected to the plurality of cylinder bores respectively are formed on an inner peripheral surface of the coupling hole of the cylinder block and a refrigerant discharge opening is formed on an outer peripheral surface of the rotary valve, wherein a bypass means for bypassing a refrigerant left within the communication hole of the cylinder bore in which a compression stroke is performed and then discharging the refrigerant to the communication hole of another cylinder bore is provided between the coupling hole and the rotary valve, and wherein the bypass means includes at least one temporary storage groove formed on an inner peripheral surface of the coupling hole of the cylinder block aloneg circumferential direction thereof, and a first discharge groove and a second discharge groove, which are formed on the outer peripheral surface of the rotary valve, communicated with the temporary storage groove with the refrigerant discharge opening being interposed therebetween.

2. The reciprocating compressor as claimed in claim 1, wherein two temporary grooves are formed on opposite sides of the communication holes.

3. The reciprocating compressor as claimed in claim 1, wherein the first discharge groove and the second discharge groove extend in the direction of the drive shaft.

4. The reciprocating compressor as claimed in claim 1, wherein the rotary valve is detachably coupled to the drive shaft.

5. The reciprocating compressor as claimed in claim 1, wherein when seen from the direction of the drive shaft, the first and second discharge grooves are stepped to have a flat surface.

6. The reciprocating compressor as claimed in claim 1, wherein when seen from the direction of the drive shaft, the first and second discharge grooves are recessed.

7. A reciprocating compressor with a rotary valve comprising:

a cylinder block having a plurality of bores;

a drive shaft rotatably supported by the cylinder block;

a plurality of pistons reciprocally accommodated within the cylinder bores;

a power transmission connecting the pistons and the drive shaft;

a housing having a suction chamber and a discharge chamber; and a rotary valve configured to rotate together with the drive shaft and slidably installed on an inner surface of a coupling hole formed in the cylinder block, wherein communication holes connected to the plurality of cylinder bores respectively are formed on an inner peripheral surface of the coupling hole of the cylinder block and a refrigerant discharge opening is formed on an outer peripheral surface of the rotary valve, wherein a bypass means for bypassing a refrigerant left within the communication hole of the cylinder bore in which a compression stroke is performed and then discharging the refrigerant to the communication hole of another cylinder bore is provided between the coupling hole and the rotary valve, and wherein the bypass means includes first and second discharge grooves formed in the rotary valve and extending in the direction of the drive shaft to be communicated with the communication holes with the refrigerant discharge opening being interposed therebetween in the direction of circumferential direction of the rotary valve, and a bypass passage formed by spacing an end of the rotary valve and a bottom of the coupling hole apart from each other to face each other such that the first and second discharge grooves are communicated with each other.

8. The reciprocating compressor as claimed in claim 7, wherein when seen from the direction of the drive shaft, the first and second discharge grooves are stepped to have a flat surface.

9. The reciprocating compressor as claimed in claim 7, wherein when seen from the direction of the drive shaft, the first and second discharge grooves are recessed.

10. A reciprocating compressor with a rotary valve comprising:

a cylinder block having a plurality of bores;

a drive shaft rotatably supported by the cylinder block;

a plurality of pistons reciprocally accommodated within the cylinder bores;

a power transmission connecting the pistons and the drive shaft;

a housing having a suction chamber and a discharge chamber; and a rotary valve configured to rotate together with the drive shaft and slidably installed on an inner surface of a coupling hole formed in the cylinder block, wherein communication holes connected to the plurality of cylinder bores respectively are formed on an inner peripheral surface of the coupling hole of the cylinder block, wherein a bypass means for bypassing a refrigerant left within the communication hole of the cylinder bore in which a compression stroke is performed and then discharging the refrigerant to the communication hole of another cylinder bore is provided between the coupling hole and the rotary valve, and wherein the rotary valve is resiliently pushed toward the inner side of the coupling hole, wherein the rotary valve includes a suction rotor installed at a rear end of the drive shaft and having an accommodating recess opened rearward and a refrigerant discharge opening formed on a side surface thereof to communicate the accommodating recess and the communication holes, a blocking wall formed between the suction chamber and the suction rotor and having a suction port communicated with the suction chamber, and a spring disposed between the suction rotor and the blocking wall to prevent a shaft from being pushed, and the refrigerant discharge opening and the communication holes are intermittently communicated with each other as the drive shaft and the suction rotor rotate, and wherein the bypass means includes first and second discharge grooves formed in the rotary valve and extending in the direction of the drive shaft to be communicated with the communication holes with the refrigerant discharge opening being interposed therebetween in the direction of circumferential direction of the rotary valve, and a bypass passage formed by spacing the facing surfaces of the suction rotor and the coupling hole apart from each other such that the first and second discharge grooves are communicated with each other.

11. The reciprocating compressor as claimed in claim 10, wherein a thrust bearing to which a force is applied by the spring is provided on the inner side of the accommodating recess.

12. The reciprocating compressor as claimed in claim 10, wherein the spring is disposed between a bottom of the accommodating recess of the suction rotor and the blocking wall.

13. The reciprocating compressor as claimed in claim 10, wherein a radial bearing is interposed between the drive shaft and the cylinder block.

14. The reciprocating compressor as claimed in claim 10, wherein a recess or a boss is formed at a rear end of the drive shaft, and a boss or a recess coupled to the recess or boss of the drive shaft is formed at a tip end of the suction rotor.

15. The reciprocating compressor as claimed in claim 14, wherein a coupling structure of the rear end of the drive shaft and the tip end of the suction rotor is a fitting structure.

16. The reciprocating compressor as claimed in claim 10, wherein when seen from the direction of the drive shaft, the first and second discharge grooves are stepped to have a flat surface.

17. The reciprocating compressor as claimed in claim 10, wherein when seen from the direction of the drive shaft, the first and second discharge grooves are recessed.

18. A reciprocating compressor with a rotary valve comprising:

a cylinder block having a plurality of bores;

a drive shaft rotatably supported by the cylinder block;

a plurality of pistons reciprocally accommodated within the cylinder bores;

a power transmission connecting the pistons and the drive shaft;

a housing having a suction chamber and a discharge chamber; and a rotary valve configured to rotate together with the drive shaft and slidably installed on an inner surface of a coupling hole formed in the cylinder block, wherein communication holes connected to the plurality of cylinder bores respectively are formed on an inner peripheral surface of the coupling hole of the cylinder block, wherein a bypass means for bypassing a refrigerant left within the communication hole of the cylinder bore in which a compression stroke is performed and then discharging the refrigerant to the communication hole of another cylinder bore is provided between the coupling hole and the rotary valve, and wherein the rotary valve is resiliently pushed toward the inner side of the coupling hole, wherein the rotary valve includes a suction rotor installed at a rear end of the drive shaft and having an accommodating recess opened rearward and a refrigerant discharge opening formed on a side surface thereof to communicate the accommodating recess and the communication holes, a blocking wall formed between the suction chamber and the suction rotor and having a suction port communicated with the suction chamber, and a spring disposed between the suction rotor and the blocking wall to prevent a shaft from being pushed, and the refrigerant discharge opening and the communication holes are intermittently communicated with each other as the drive shaft and the suction rotor rotate, and The reciprocating compressor as claimed in claim 8, wherein the bypass means includes at least one temporary storage groove formed on an inner peripheral surface of the coupling hole of the cylinder block along a circumferential direction thereof, and a first discharge groove and a second discharge groove communicated with the temporary storage groove with the refrigerant discharge opening being interposed therebetween formed in the direction of circumferential direction of the rotary valve.

19. The reciprocating compressor as claimed in claim 18, wherein two temporary grooves are formed on opposite sides of the communication holes.

20. The reciprocating compressor as claimed in claim 18, wherein the first discharge groove and the second discharge groove extend in the direction of the drive shaft.

21. The reciprocating compressor as claimed in claim 18, wherein when seen from the direction of the drive shaft, the first and second discharge grooves are stepped to have a flat surface.

22. The reciprocating compressor as claimed in claim 18, wherein when seen from the direction of the drive shaft, the first and second discharge grooves are recessed.

* * * * *